US006381759B1

(12) United States Patent
Katz

(10) Patent No.: US 6,381,759 B1
(45) **Date of Patent: *May 7, 2002**

(54) IMPACT ABSORBING PROTECTIVE APPARATUS FOR THE FRONTAL, TEMPORAL AND OCCIPITAL BASILAR SKULL

(76) Inventor: Jeffrey P. Katz, 632 Rainbow Span, Columbia, MD (US) 21045

( * ) Notice: Subject to any disclaimer, the term of this patent is extended or adjusted under 35 U.S.C. 154(b) by 0 days.

This patent is subject to a terminal disclaimer.

(21) Appl. No.: 09/072,048

(22) Filed: May 5, 1998

Related U.S. Application Data

(63) Continuation of application No. 08/759,120, filed on Dec. 2, 1996, now Pat. No. 5,745,923.

(51) Int. Cl.[7] ..... A42B 3/00
(52) U.S. Cl. ..... 2/425; 2/414; 2/410
(58) Field of Search ..... 2/425, 410, 411, 2/414

(56) References Cited

U.S. PATENT DOCUMENTS 4,345,338 A * 8/1982 Frieder, Jr. et al. ..... 2/414
4,982,451 A * 1/1991 Graham ..... 2/410
5,177,815 A * 1/1993 Andujar ..... 2/411
5,269,025 A * 12/1993 Broersma ..... 2/411
5,481,762 A * 1/1996 Gentes et al. ..... 2/411
5,745,923 A * 5/1998 Katz ..... 2/411

* cited by examiner

*Primary Examiner*—Gloria M. Hale
(74) *Attorney, Agent, or Firm*—Nath & Associates PLLC; Gary M. Nath; Marvin C. Berkowitz

(57) ABSTRACT

A helmet for protection against non-motorized injuries comprises a number of arched segments with ventilation spaces between them, the arched segments being shaped to extend about and engage the skull. The helmet is constructed to cover the apical as well as the frontal, temporal and occipital basilar skull. The arched segments are convex on their outer surfaces, have flat, curved inner surfaces, and are made of a cushioning, impact absorbing material such as plastic foam. Reinforcing elements extend in longitudinal passages in the arched segments to provide resistance against forces which are only partly absorbed by the cushioning material. In an alternate embodiment, support straps extend over the apical skull, and an impact resistant helmet is worn over the apical skull.

13 Claims, 4 Drawing Sheets

IMPACT ABSORBING PROTECTIVE APPARATUS FOR THE FRONTAL, TEMPORAL AND OCCIPITAL BASILAR SKULL

This application is a continuation application of U.S. patent application Ser. No. 08/759,120, filed Dec. 2, 1996, U.S. Pat. No. 5,745,923 the entire contents of which is hereby incorporated in its entirety.

BACKGROUND OF THE INVENTION

1. Field of the Invention

The present invention relates to protective head pieces, particularly light weight helmets for non-motorized activities.

2. Brief Discussion of the Prior Art

There has long been a need for a lightweight, economical, comfortable, but very effective safety helmet for non-motorized sports enthusiasts. Non-motorized sports activities include bicycling, skiing, and hockey, for example. In these activities, the velocity of impact is less than in motorized vehicle activities, such as automobile travel, snow mobiles, and motor boats. Since the force delivered by an impact is proportional to the square of the impact velocity, impacts from non-motorized activities are substantially smaller, but nevertheless can cause significant skull injury.

Numerous medical journal articles recite typical traumatic injuries to the head which result from bicycle accidents. Specifically, Kitchens, J. L., Groff, D. B.; Basilar Skull Fractures in Childhood with Cranial Nerve Involvement, J. Pediatr. Surg. 1991 Aug. 26 (8); 992–4, and McGuirt and Stook (Temporal Bone Fractures in Children: A Review With Emphasis on Long Term Sequelae, Clinical Pediatrics, January, 1992, page 12) noted that basilar skull fractures may occur in as much as 14% of head injuries in children. West et al (Transsphenoid Basilar Skull Fracture: CT Patters", Neuroradiology, August, 1993, page 329) noted that basilar skull fracture complications in 40 patients included 11 deaths, blindness, cranial nerve injury, CSF (leakage of cerebrospinal fluid), hearing loss and other such injuries.

Published data indicates that of individuals wearing helmets, most impacts occurred on areas of helmets not tested during certification to a standard. All serious head injury occurred when either the helmet; a) came off the wearer's head, b) collapsed due to a structural defect in the helmet, or c) was struck predominantly below the rim. Current standards fail to identify the basilar skull as requiring protection: see "Standard Test Methods for Equipment and Procedures Used In Evaluating the Performance Characteristics of Protective Headgear", American Society for Testing and Materials, designations F 1446-95; "Standard Specification for Protective Headgear Used in Bicycling", American Society for Testing and Materials, designations F 1446-94; Australian Standard (AS 1986), U.S. Snell (Snell 1984), and ANSI-Z90.4 (ANSI 1984).

U.S. Design Pat. No. 336,552 to Timms et al shows a crossbar over the top opening of the helmet. U.S. Pat. No. 3,425,061 to Webb discloses an outer protective shell arranged over a layer of energy absorbing material and an additional inner protective layer; forming ribs integrally and extending the layers transversely across each other provides energy absorption.

U.S. Pat. No. 5,088,130 to Chiarella discloses a plastic outer shell with a shock absorbent molded inner layer and a chin strap.

The helmets disclosed in the above patents and other helmets known in the prior art fail to provide protection to the frontal, temporal and occipital basilar skull, and fail to provide a helmet structure which is both shock absorbing and protective of the skull against impact forces.

SUMMARY OF THE INVENTION

A helmet is provided which is particularly for protection of the skull, including protection against injury to the apical as well as the basilar skull including frontal, temporal and occipital portions, in order to protect the skull in accidents, particularly from non-motorized sport activities. The helmet comprises a number of arched segments, each of which has an outer convex surface and an inner, substantially flat surface for engaging a generally curved surface of the skull. The segments are of cushioning material which is capable of yielding under impact forces to absorb some of the energy of these forces; it is preferably of a suitable plastic foam material made from expanded polypropylene beads. Within each segment there is a longitudinally extending hollow passage in which there is a relatively stiff plastic reinforcing element to resist impact on the skull from forces which are partly absorbed by the cushioning material of the segments. The helmet also includes a retaining element for engaging the chin of the wearer, the retaining element extending from the occipital and temporal areas. In an alternative embodiment, the protective helmet may include only arched segments beginning at the basilar skull, and extending downwardly, with support straps extending over the cranium and connected to the arched segments, in order to receive on the cranium of the wearer a detachable, impact resistant helmet.

Among the objects of the present invention are to provide a helmet for absorbing impacts from non-motorized sports, falls, etc. which effectively reduces or minimizes injury to the skull including the frontal, temporal, and occipital basilar skull.

Another object of the present invention is to provide a helmet which will protect against injuries to the areas below the test lines designated in current standard specifications for helmets.

Yet another object of the present invention is to provide a helmet which protects the human skull against injury by both force absorbing and impact resisting elements.

It is yet another object of the invention to provide a protective head piece that is economical and simple to manufacture.

These and other objects of the invention will be apparent from the following drawings and detailed description of the invention.

BRIEF DESCRIPTION OF THE DRAWINGS

The present invention will be fully understood by reference to the following drawing figures wherein.

DETAILED DESCRIPTION OF THE PREFERRED EMBODIMENTS

Figure 1:
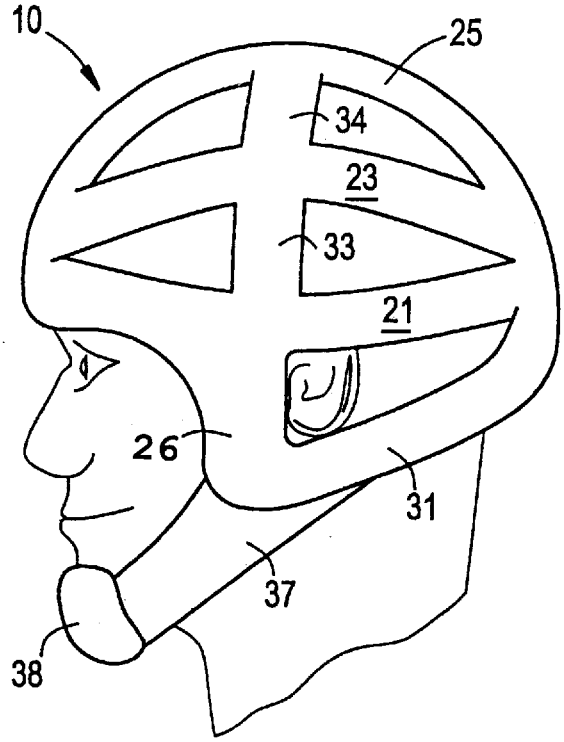
FIG. 1 is a side view of a helmet in accordance with the present invention on a person's head.

Referring now to the drawings wherein like or corresponding reference numerals are used for like or corresponding parts throughout the several views, there is shown in FIG. 1 a helmet 10 in accordance with the present invention in place on a human head H. The helmet comprises a plurality of arched segments 20 which extend over and about the skull. As shown best in FIG. 2, there is a left temporal segment 21 and a right temporal segment 22 which merge at the front of the helmet, passing about the skull at or just over the eyebrows, and the segments 21 and 22 also merge at the occipital region of the skull.

Figure 3:
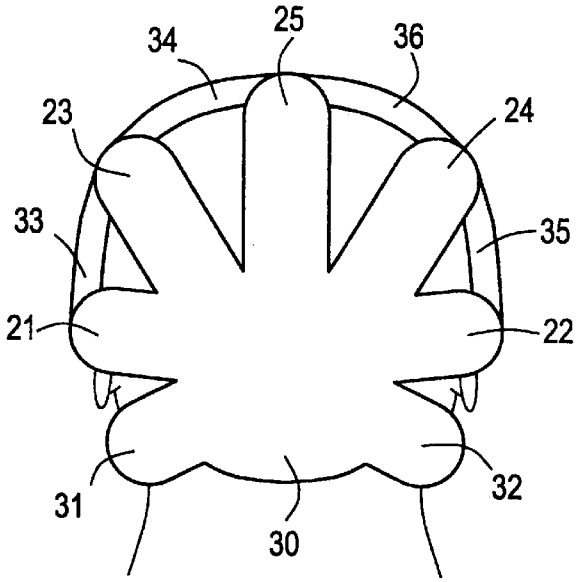
FIG. 3 is a view taken from the rear of FIG. 1.

A central cranial segment 25 extends from the front of the segments 21 and 22 over the crown of the skull and is joined at the juncture region 30 (FIG. 3). Between and spaced from the segments 21 and 25 is a left median segment 23, and between the central segment 25 and the right temporal segment 22, and generally spaced from them is a right median segment 24.

Extending from the juncture region 30 there is a left basilar segment 31 and a right basilar segment 32, these segments extending somewhat downwardly and towards the mandibular region, covering the lower parts of the ears. The forward end of the left basilar segment 31 (FIG. 2) merges with and is joined to a left sub-temporal segment 26 extending downwardly from the left temporal segment 21, and the right basilar segment 32 merges with and is joined to a right sub-temporal segment 27 extending downwardly from the right temporal segment 22. A lower left cranial segment 33 and an upper left cranial segment 34 extend between, respectively, the left temporal segment 21 and the left median segment 23, and between left median segment 23 and central segment 25. As shown in FIG. 3, lower right cranial segment 35 extends between right temporal segment 22 and right median segment 24, and upper right cranial segment 36 extends between right median segment 24 and central segment 25.

A chin strap 37, as shown in FIG. 1, descends from the left basilar segment 31, and a similar chin strap (not shown) descends from the right basilar segment 32. These chin straps 37 are connected by a suitable fastener, such as a buckle, and one or both of the chin straps 37 may be provided with a chin cushion 38. The chin strap secures the helmet 10 on the head and serves to retain it against becoming dislodged. The chin strap 37 descends from the temporal and occipital regions of the helmet, without obstructing the ears of the wearer. Further, the segments are light-reflective, as by having a suitable coating on their outer surfaces.

Figure 2:
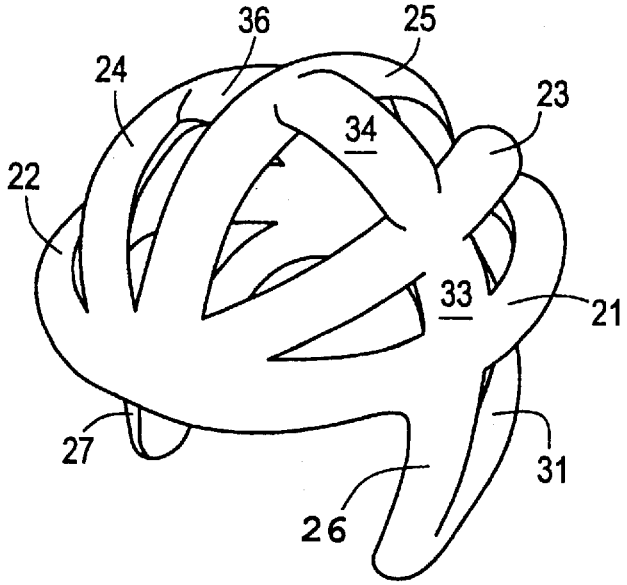
FIG. 2 is a perspective view of the helmet of FIG. 1, with parts removed.

As shown in FIGS. 2 and 3 in particular, the segments are spaced apart to provide for ventilation, the width of a segment being approximately two inches, for example, with spacing between them of about one inch at the region of maximum spacing. Thus, adequate ventilation is provided to dissipate heat and achieve a reasonable level of comfort while protecting the wearer.

Figure 4:
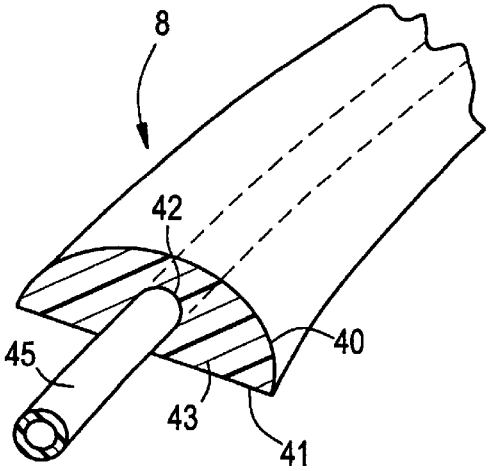
FIG. 4 is an exploded view of a portion of a segment of the helmet of FIG. 1.

As shown in FIG. 4, which is an exploded perspective view of a portion of a segment S, which may be any of the segments shown in FIGS. 1–3, is of arched configuration longitudinally, having an outer convex surface 40 and an inner, substantially flat surface 41. A passage 42 of generally circular transverse cross-section of extends through the body 43 of segment S. The arched segment, illustrated by segment S in FIG. 4, is of cushioning material which is capable of yielding to absorb impact forces.

The cushioning material of the body 43 is preferably of a suitable plastic foam material, which is made from expanded polypropylene, EPAM sponge produced by Lauren Manufacturing Company, New Philadelphia, Ohio. The material is an ASTM D-1056 2AZ, and is sold in bulk footage.

There is also shown in FIG. 4 a reinforcing element 45 which is of generally cylindrical construction, of a size and shape to fit snugly in the passage 42 of the segment S, so as to substantially fill it. Reinforcing element 45 is relatively stiff, being made of a rigid or semi-rigid plastic material and is fabricated to resist impact on the skull from forces which are partly absorbed by the cushioning material of the body 43 of segment S.

Figure 5:
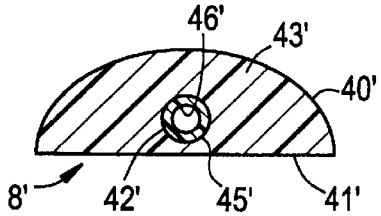
FIG. 5 is an end view of a modified element of the helmet in accordance with FIG. 1.

FIG. 5 is a cross-sectional view of a modified segment S', segment S' being wider relative to the height of segment S, as provided by the somewhat wider outer convex surface 40' and flat arched inner surface 41'. The passage 42' is elliptical in cross-section, as is the reinforcing element 45'. The reinforcing element 45' has a passage 46' extending longitudinally through it, to reduce its resistance to deformation, so as to provide reinforcement, but with greater ability to yield to forces imposed on it through the body 43' of the segment S'.

Reinforcing element 45, 45', may be of other constructions than that described above. For example, the reinforcing element may be formed as a sealed chamber of pliable material having within it a gas, such as air, under superatmospheric pressure. Further, the reinforcing element may be constructed as a sealed chamber of pliable material having a gel substantially filling it.

Figure 6:
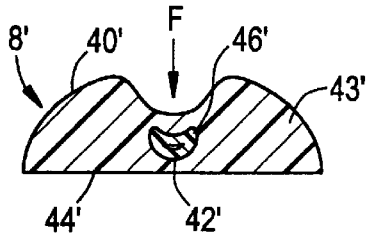
FIG. 6 is an illustration of the action of the structure of FIG. 5 upon receiving an impact force.

FIG. 6 illustrates the result of an external force F applied to the segment S', the illustration being equally applicable to the segment S. The force F is received by the body 43' and is shown as being substantially perpendicular to inner surface 41'; however, it is to be appreciated that this is illustrative only, since the force F may be delivered at an angle to the inner surface 41'. Upon the force F being applied, as from engagement of the outer surface 40' with or by an object, the body 43' will yield, absorbing some or all of the energy from the force F. In the event that the force F is so great that the body 43' does not absorb all of the energy of force F, reinforcing element 45' will be deformed, as shown in FIG. 6, and will absorb some or all of the remaining energy, so that there is delivered to the skull which is in engagement with inner surface 41' a force which is much less than the force F which impacted on the outer surface 40'.

Figure 7:
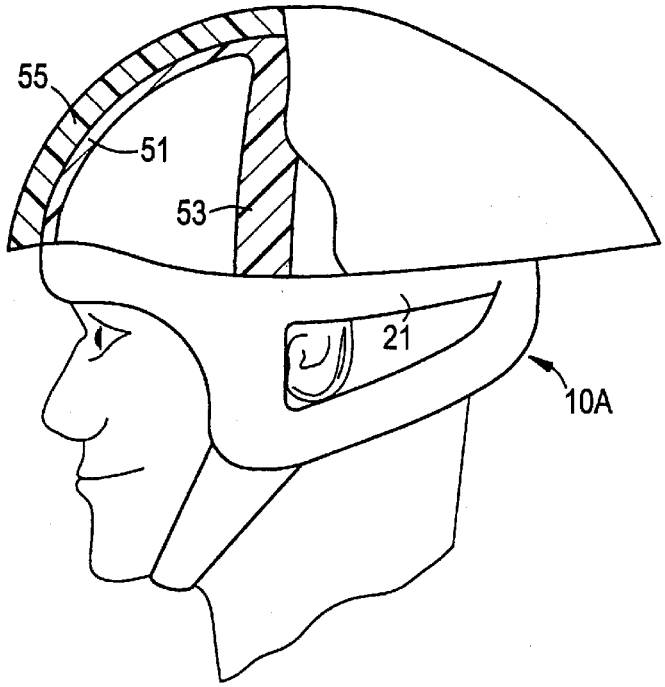
FIG. 7 is a view similar to FIG. 1, with parts in section, showing a helmet of the present invention worn with a bicycle style impact resistant helmet.
Figure 8:
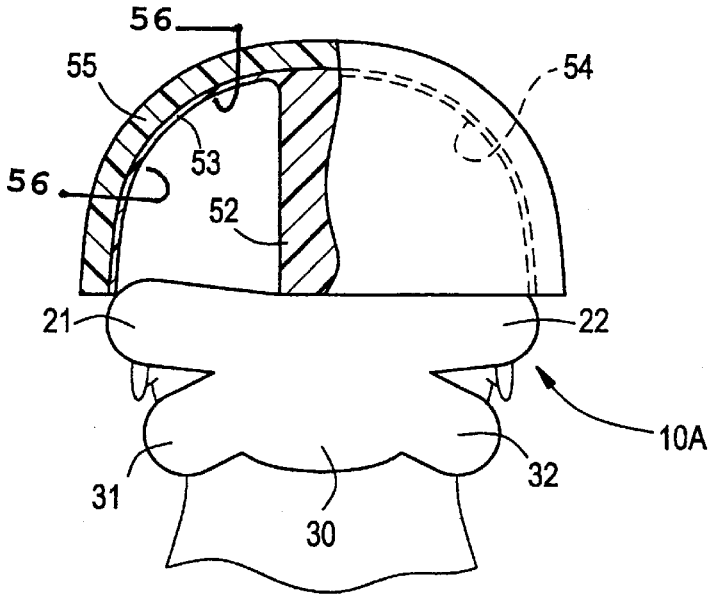
FIG. 8 is a view taken from the rear of FIG. 7, with parts in section.

In FIGS. 7 and 8, there are shown, respectively, side and rear views of a helmet which comprises segments as above discussed which extend about the basilar skull, with straps connected to some of the segments which support the segments on the head and extend over the cranium. A separate protective, impact resistant helmet is placed over these straps. Thus, in FIGS. 7 and 8, there is shown a helmet 10*a* comprising left and right temporal segments 21 and 22 which, as in helmet 10, merge at the front of the helmet at or just over the eyebrows, and also merge at the occipital region of the skull. There may also be seen left basilar segment 31 and right basilar segment 32 which extend to the merger region 30, as in FIG. 1. However, the helmet 10*a* is provided with supporting front strap 51, supporting rear strap 52, supporting left side strap 53 and supporting right side strap 54. These supporting straps extend over the cranium, preferably from front to back and from side to side, as shown. An impact resistant helmet 55 such as a bicycle helmet is placed over the cranium and over the support straps 51, 52, 53 and 54. Helmet 55 extends to adjacent the arched segments 21 and 22, and being an impact resistant helmet, may be removed for the comfort of the wearer when appropriate. The helmet 55 may be attached by appropriate fasteners or the like (not shown) so as to remain in place on the cranium of the wearer.

Figure 9:
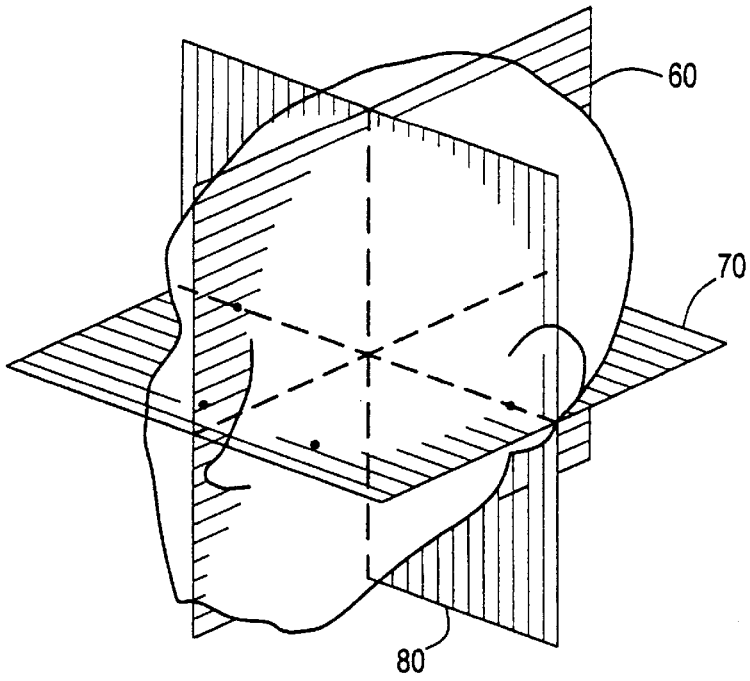
FIG. 9 is a view illustrating the major anatomical planes of the human head.
Figure 10:
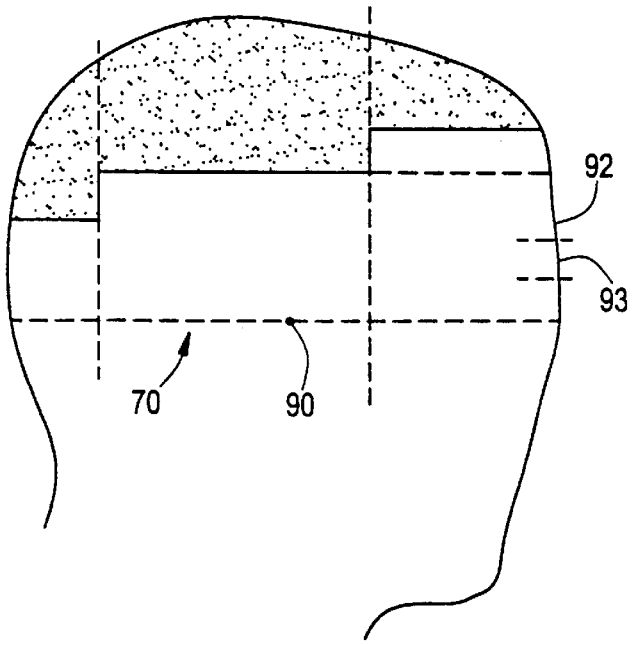
FIG. 10 is a diagram of major anatomical planes of the human head.

Referring to FIGS. 9 and 10, there is provided a discussion of the relationship of the construction of helmet 10 to the anatomy of a human skull and how the helmet 10 protects all parts of the skull including frontal, temporal and occipital basilar skull.

In FIG. 9, there are shown the major anatomical planes of the skull, these being the basic plane 70, the midsagittal or longitudinal plane 60, and the coronal or transverse plane 80.

The basic plane 70 is the anatomical plane which includes the superior rims of the auditory meatuses, the upper edges of the external openings at the ears, and the notches of the interior orbital ridges at the bottom edges of the eye sockets.

The midsagittal plane 60 is perpendicular to the basic plane and passes through (a) the mid point of the line connecting the notches of the right and left inferior orbital ridges at the bottom edges of the eye sockets, and through (b) the mid point of the line connecting the superior rims of the right and left auditory meatuses at the upper edges of the external openings of the ears.

The coronal plane 80 is perpendicular to both the basic plane 70 and the midsagittal plane 60 and passes through the mid point of a line connecting the superior rims of the right and left auditory meatuses.

Turning now FIG. 10, there is shown a human skull with the midsagittal longitudinal plane 60, which passes through the center of the auditory meatuses 90. The forehead or frontal region of the skull 92 is indicated, the eye sockets being indicated at 93. The shaded area on the skull is the area or region of the skull which is intended to be protected by the above noted current standard specification for helmets referenced hereinabove, i.e., principally the cranial region of the skull. Thus, these standards fail to require helmets which protect the basilar skull, comprising the forehead or frontal part of the skull, the sides or temporal portions of the skull, and the back or occipital portion of the skull. In contrast, as is clearly apparent from FIGS. 1–3 and 7 and 8, the helmets of the present invention protects these regions, as well as the crown region of the skull. These helmets meet the noted standards for protective helmets.

The claims and specification describe the invention presented, and the terms that are employed in the claims draw their meaning from the use of such terms in the specification. Some terms employed in the prior art may be broader in meaning than specifically employed herein. Whenever there is a question between the broader definition of such term as used in the prior art and the more specific use of the term herein, the more specific meaning is meant.

I claim:

1. A helmet shell liner for a human head comprising, a plurality of longitudinal arched shaped segments for encircling the frontal temporal and occipital basilar skull of a human head;

each of said arched shaped segments having a hollow passage extending longitudinally therein and being of cushioning material capable of yielding to absorb impact forces;

a relatively stiff reinforcement element in said passage of each said arched segment; and a fastener connecting said longitudinal arched shaped segments to a helmet shell.

2. A helmet shell liner for a human head as claimed in claim 1 wherein said fastener fastens only portions of said longitudinal arch shaped segments located toward a base of said helmet shell liner.

3. A helmet shell liner for a human head comprising, a plurality of longitudinal arched shaped segments for encircling the frontal temporal and occipital basilar skull of a human head;

each of said arched shaped segments having a hollow passage extending longitudinally therein and being of cushioning material capable of yielding to absorb impact forces;

a reinforcement element located in said hollow passage of at least one said arched segment.

4. A helmet shell liner for a human head as claimed in claim 3 wherein said reinforcement element is air.

5. A helmet shell liner for a human head as claimed in claim 3 wherein said reinforcement element is a solid material.

6. A helmet shell liner for a human head as claimed in claim 3 wherein said reinforcement element is a non-solid material.

7. A helmet shell liner for a human head as claimed in claim 3 wherein said reinforcement element located toward a bottom portion of said helmet shell liner is air.

8. A helmet shell liner for a human head as claimed in claim 1 wherein said fastener fastens only portions of said longitudinal arch shaped segments located toward a base of said helmet shell liner.

9. A helmet shell liner for a human head as claimed in claim 2 wherein each of said longitudinal arch shaped segments has a hollow passage extending longitudinally therein and a relatively stiff reinforcement element is located in said passage of each said longitudinal arch shaped segment.

10. A helmet shell liner for a human head as claimed in claim 9 wherein said relatively stiff reinforcement element is an inflated bladder.

11. A helmet shell liner for a human head as claimed in claim 10 wherein said bladder is inflated with a gas.

12. A helmet shell liner for a human head as claimed in claim 10 wherein said bladder is inflated with a gas.

13. A helmet shell liner for a human head as claimed in claim 12 wherein said liquid is a gel.

* * * * *